US005899243A

United States Patent [19]

Moriyama

[11] Patent Number: 5,899,243

[45] **Date of Patent: * May 4, 1999**

[54] METHOD FOR ADDING AND REMOVING A LIQUID PRODUCT FROM AN ATMOSPHERIC STORAGE TANK

[75] Inventor: Alberto Moriyama, Sao Paulo, Brazil

[73] Assignee: Frontenge Engenharia Ltda, Sao Paulo, Brazil

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,159

[22] Filed: Nov. 4, 1996

Related U.S. Application Data

[62] Division of application No. 08/142,430, filed as application No. PCT/BR93/00009, Mar. 26, 1993.

[30] Foreign Application Priority Data

Mar. 26, 1992 [BR] Brazil ..... 19201048

[51] Int. Cl.[6] ..... B65D 90/38

[52] U.S. Cl. ..... 141/7; 141/2; 141/25; 141/48; 141/59

[58] Field of Search ..... 141/7, 10, 25, 141/27, 59, 1, 2, 5, 18, 21, 48, 114; 220/403, 410, 465, 564, 4.12, 495.01, 495.06, 495.08, 495.1

[56] References Cited

U.S. PATENT DOCUMENTS

| | | | |
|---|---|---|---|
| 1,743,056 | 1/1930 | Whitaker | 141/27 |
| 3,286,742 | 11/1966 | Doll | 141/27 |
| 3,623,629 | 11/1971 | Hendershot . | |
| 3,747,800 | 7/1973 | Viland | 220/465 |
| 4,008,621 | 2/1977 | Ostojic et al. | 141/25 |
| 4,135,443 | 1/1979 | Warren | 99/646 S |
| 4,457,441 | 7/1984 | McCloughan . | |
| 4,499,820 | 2/1985 | Nelson | 99/646 S |
| 4,625,980 | 12/1986 | Lyzohub . | |
| 4,635,814 | 1/1987 | Jones . | |
| 4,852,765 | 8/1989 | Lyzohub | 220/461 |
| 5,110,005 | 5/1992 | Schilling . | |
| 5,503,291 | 4/1996 | Craig | 220/403 |
| 5,595,315 | 1/1997 | Podd et al. | 220/403 |

FOREIGN PATENT DOCUMENTS

| | | |
|---|---|---|
| 2 454 420 | 11/1980 | France . |
| 3 209 591 | 9/1983 | Germany . |
| 84/04 515 | 11/1984 | WIPO . |
| 85/01035 | 3/1985 | WIPO . |

*Primary Examiner*—J. Casimer Jacyna
*Attorney, Agent, or Firm*—Pillsbury Madison & Sutro LLP

[57] ABSTRACT

A method for adding or removing a liquid product to or from a tank using a breather bag attached to an upper air vent of the tank. Prior to adding a liquid product, the bag is filled with external air either by force or atmospheric pressure, and a liquid product is added to the tank between the bag and tank while simultaneously forcing the external air out of the bag by force on the bag caused by addition of a liquid product into the tank. As liquid product is removed from the tank through an outlet valve, the breather bag is sucked downward by the vacuum created between the bag and tank as the liquid product is removed. In both processes, the liquid product is separated from the external air by the breather bag, yielding the following advantages. Evaporative losses of liquid products stored in atmospheric tanks are averted. Thus, environmental pollution by product gases that would be expelled out of the tanks is avoided. The entry of flames due to fire in atmospheric storage tanks that contain flammable or combustible liquids is avoided, so that the chances of an accident are reduced. Hydrocontamination of stored liquid product by water present in atmospheric air in atmospheric storage tanks is also avoided. Likewise, contact between the stored liquid product and atmospheric air oxidizing compounds can be avoided. Finally, the entry of extraneous objects into liquid products stored in atmospheric storage tanks like insects and small animals or birds, which may infect the stored liquid products, is avoided.

9 Claims, 5 Drawing Sheets

Fig. 7
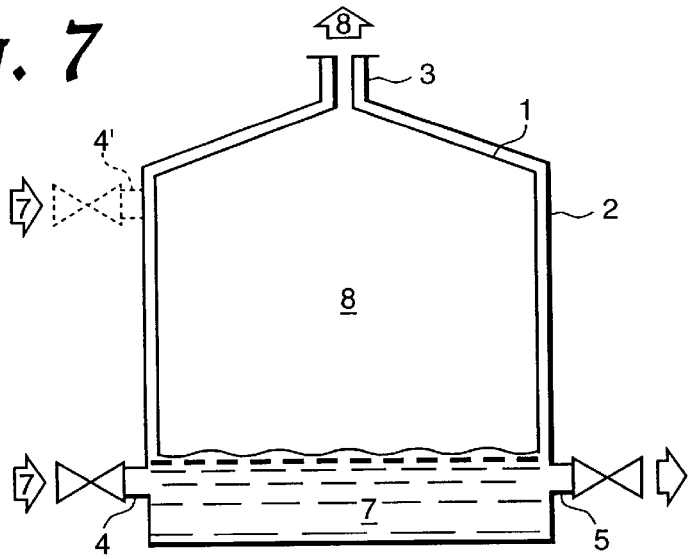
Fig. 8
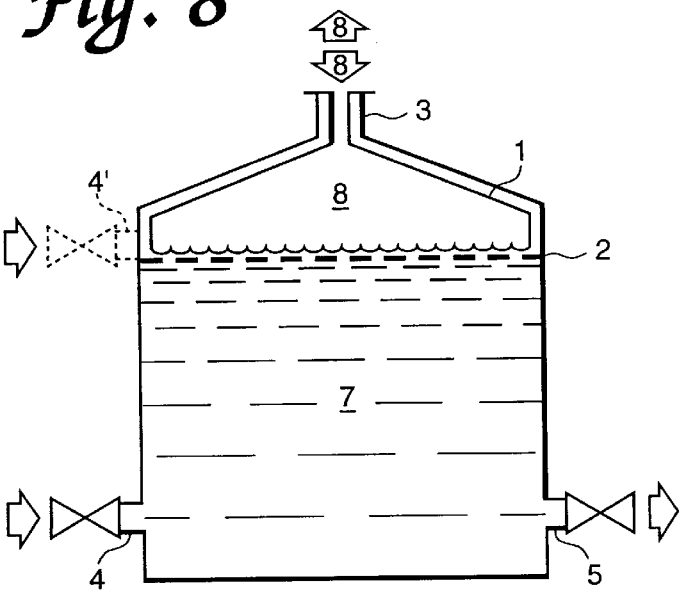
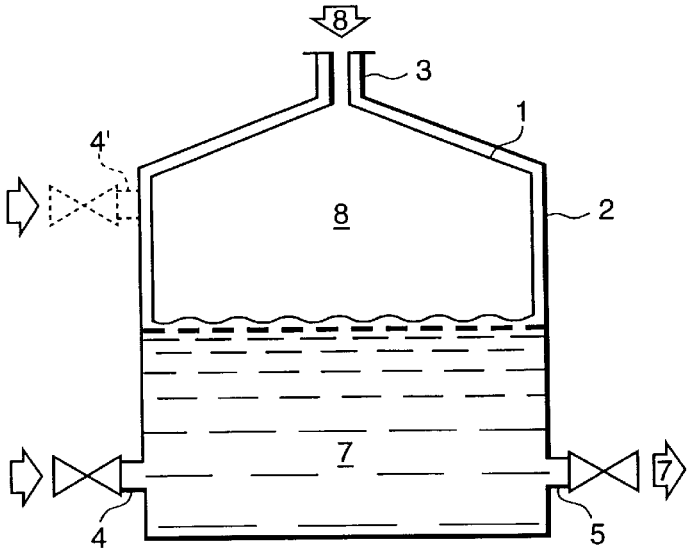
Fig. 9

Fig. 10
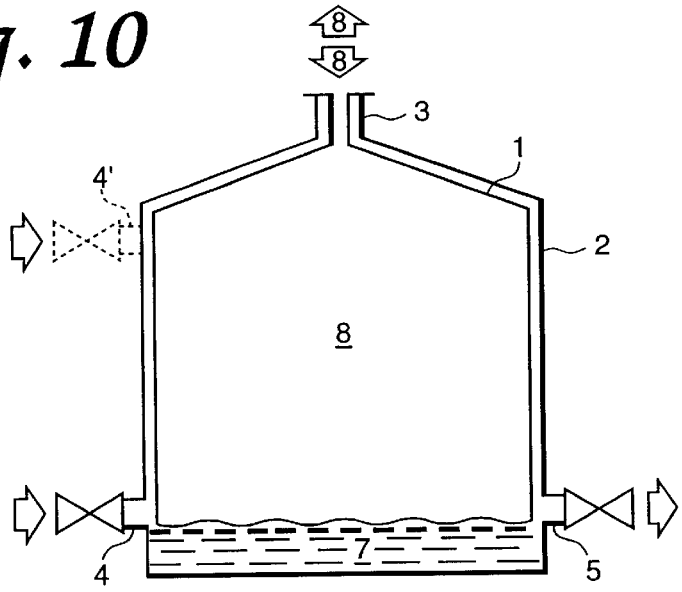
Fig. 11
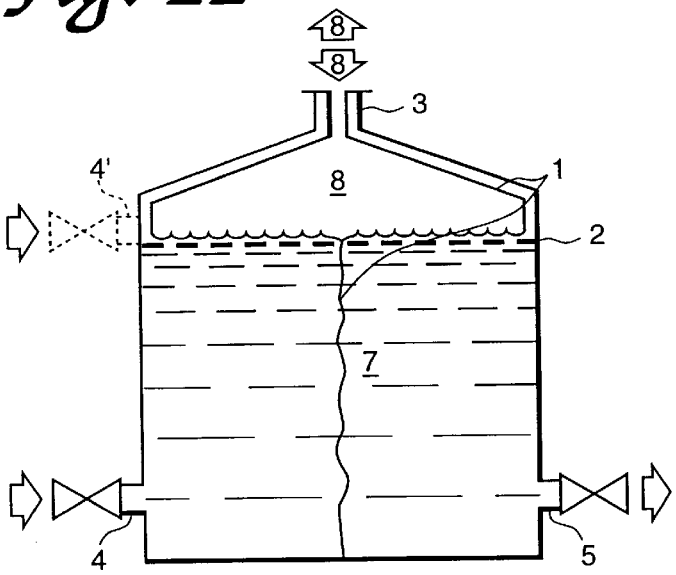
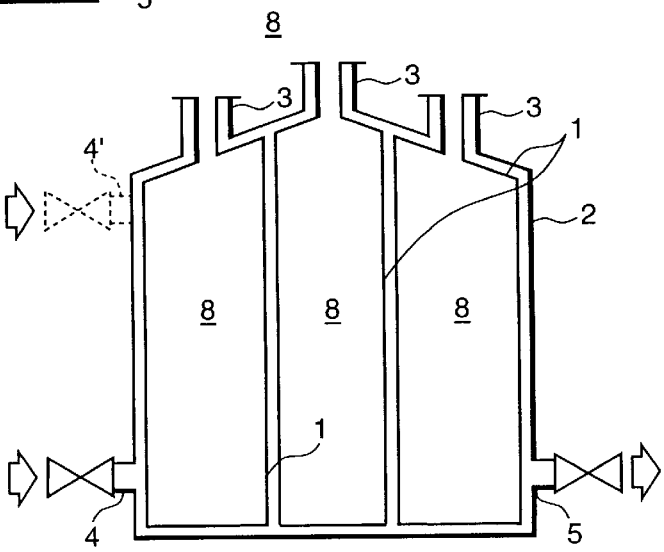
Fig. 12

METHOD FOR ADDING AND REMOVING A LIQUID PRODUCT FROM AN ATMOSPHERIC STORAGE TANK

This application is a division of application Ser. No. 08/142,430 filed Nov. 26, 1993, and still pending, which was the national phase of International Application PCT/BR93/00009 filed Mar. 26, 1993.

BACKGROUND OF THE INVENTION

1. Field of the Invention

The present invention refers to a breather bag made with an impermeable and flexible membrane and having an appropriate shape, for use in open type or closed type tanks for storage and/or transportation of liquid products under atmospheric pressure. Specifically, the present invention refers to a bag that is produced by using a membrane that, working as a breather in a storage tank, guarantees that the air vent of the storage tank will work normally, without discharacterization of its qualification in storage and/or transportation of liquid products under atmospheric pressure. Additionally, it makes possible the operation of air venting in storage tanks with physical segregation between the stored liquid product and the atmospheric air and environment.

2. Description of Related Art

As it is well known, a storage tank is of an atmospheric type when its inner side communicates with the environment (atmosphere) by a free way (air vent hole) and the internal pressure on the tank's wall is based on its stored liquid column height.

An atmospheric storage tank is called closed type when it communicates with the environment through a neck containing a top opening (connection or nozzle) called an air vent. An atmospheric storage tank is called open type when it is neckless and communicates with the environment entirely through the full exposed surface of its stored liquid product.

The air vent of the closed type atmospheric storage tanks has the following functions:

To counterbalance the inside vacuum pressure that would be formed in the storage tanks, by allowing the free entry of atmospheric air. This free way entry may be due to a decrease in ambient temperature, that would consequently cause the contraction of air+gases mixture volume contained in the vapor space of the tanks and due to withdrawal operation of liquid product stored in the tanks.

To counterbalance the internal pressure that would be developed inside the storage tanks, with free way blow out of air+gases mixture contained in the vapor space of the tanks through the vent hole due to an increase in the ambient temperature (consequently, the expansion of air+gases mixture volume contained in vapor space of the tanks would occur) and due to filling operation of liquid product to store in the tanks.

In this way, the mechanical strength design calculation of atmospheric storage tanks takes into account only the stress due to the height of stored liquid product in the tanks.

Atmospheric storage tanks are commercially available in a wide range of alternative forms, as:

a) By geometrical characteristics:
- a1) Closed type, with air vent hole, as:
  - Tank;
  - Barrel;
  - Drum;
  - Lidded bucket;
  - Bottle;
  - Can.
- a2) Open type, with full exposed surface,
  - Pool;
  - Basin;
  - Lidless bucket;
  - Open box.

b) By installation and using type:
- b1) Fixed mounted pattern, as:
  - Outdoor;
  - Indoor;
  - Buried (underground).
- b2) Mobile mounted pattern, as:
  - Part of engine system and/or aggregated to carrying vehicle, for:
    - Road way transport (as car);
    - Rail way transport (as train);
    - Water way transport (as ship);
    - Air way transport (as aircraft).
  - Shaped for handling and transportation (as container);
  - Skid-mounted type.

The atmospheric storage tanks are normally used for storing liquid products of several natures, as:

Water;

Waste disposals (effluents and drainages);

Chemical products;

Petroleum and derivated products;

Vegetable origin extracts;

Animal origin extracts;

Slurries of mineral processing.

The liquid products to be stored in atmospheric tanks may present some characteristics, with specific applicable requirements concerning quality and security to be observed in each case, such as:

Combustible and/or flammable property;

Chemical activity;

Sanitary quality;

Hygroscopic property;

Odor, harmful to health and/or comfort of the people.

The liquid product is naturally subject to evaporation when gases are detected from the liquid gas separation surface. These gases are expelled through the air vent to the environment. This normally occurs for a dead state, and, more markedly, during the filling operation of the product in the atmospheric tank, by causing serious inconveniences like:

Environment pollution;

Fire and explosion hazard;

Evaporation loss;

Corrosion attack on neighboring construction and structures.

The atmospheric air which contains water vapors in its composition enters into the storage tanks through the vent and may cause several other problems, such as:

Contamination of hygroscopic products;

Water condensation in the vapor space of the tank that will cause:
- Formation of water pocket in the liquid product;
- Water emulsion in stored liquid product.

The communication between existent storage tanks and the environment by a free way through a vent hole, allows the entry into tank of insects, small animals or birds. These small creatures, when confined inside the tanks, may contaminate stored liquid product either by their excrement or via putrefaction of the bodies of dead animals, which have obviously been trapped in the tanks for a little too long. In this case, if there is a sanitary requirement of the liquid product, the contamination may forbid use of the liquid for consumption in food or pharmaceutical uses.

The PCT document number WO 84/04515, dated Nov. 22, 1984 and entitled Method and Device for Permanently Storing Liquids Particularly Volatile Liquids into Containers Closed Under Atmospheric Pressure, explains a process and a device that is applicable only to volatile liquid storage tanks, characterized in that the mass of the stored product is constant, under atmospheric pressure, in a closed-type storage system. The purpose of these devices is the elimination of product losses that occur through the tank's vent hole, because of either liquid product evaporation or its volume change, the latter one caused by product thermal variation.

The following points can be noted in the referenced document:

- The operation mode of the presented device needs the aid of many operating accessories, and it depends on manipulation operations of the pressurization and depressurization systems.
- The device includes internal pressure control valves, making the tank slightly pressurized.
- The device keeps the vapor space of the storage tank hermetically closed; internal pressure change due to thermal variation of stored liquid product in the tank is transmitted to a plastic bag piece; the pressure of this bag piece is relieved to the environment through a pressure control valve.
- In the device, when the plastic piece is installed in the tank, the last one is kept fully charged with liquid product at its useful volume, and the first one is installed at the tank vapor space.
- There is water condensation at an inner side of the plastic piece, due to atmospheric air containing water vapor that is introduced and kept in the bag as the system is hermetically closed and does not allow water vapors to blow out of the bag. The structures requires that the device have a piping system with a suction valve to purge out condensed water from the inner side of the plastic piece.

Another PCT document, number WO 85/01035, dated Mar. 14, 1985 and entitled Process and Device For Eliminating Losses Due to the Filling and Vapor Evolution in the Case of Volatile Substances Stored in Horizontal Cylindrical Tanks, explains a process and a device with specific application in cylindrical horizontal tanks, whose purpose is to eliminate the evaporation losses of stored products through the vent hole, during tank filling operation and by natural evaporation.

Like the earlier document, this device is also applicable specifically in storage tanks for volatile liquid products only, and so that the presented process has a pressurization and depressurization system too. The device has a plastic piece like a bag, hermetically closed inside the tank, attached to a blind flange at a top connection of the tank and joined to a pressurization and depressurization piping system. It complements the tank's other internal parts.

This plastic piece is inflated in the interior of the tank by using a gaseous material. Before its installation the vapor space of the tank is made inert using Halon gas. The normal operation of this device depends on low pressure nitrogen gas in the bag.

As noted with the first device, inside the plastic piece of the device, condensation of water vapors from atmospheric air will also occur. The presence of atmospheric air is due to its entry in the bag during operation. To purge out the condensed water, a suction valve connected to a piping system is needed.

On the other hand, the existing inner casing pipe allows evaporation of a small fraction of stored liquid proportional to its sectional area. Consequently, this device's efficiency is not 100% for avoiding liquid product evaporation loss.

In summary, it is possible to assert that processes and devices disclosed in document numbers WO 84/04515 and WO 85/01035 present the following inconveniences:

- The devices consume energy and raw materials (gases);
- Constant vigilance is required during storage;
- Frequent maintenance is required;
- System start-up is vary hard and laborious;
- The purpose is only to eliminate evaporation losses of liquid products stored in atmospheric tanks.

SUMMARY OF THE INVENTION

Therefore, the most important goal of this present invention is to provide a way to definitively solve the above listed problems and inconveniences.

Another object of the present invention is to provide a way not only to provide a definitive solution for the above listed difficulties by avoiding evaporation losses of liquid products stored in a atmospheric tank but also to provide a way to avoid liquid product contamination due to entry of atmospheric air into a tank and consequent exposition of the liquid product to atmospheric air.

Also, another objective of this invention is to provide a way to eliminate evaporation losses and contamination of liquid products stored in atmospheric tanks, applicable either to closed type tanks or to open type tanks.

The above listed and other goals may be reached by using this present invention that has as principal characteristics the following points:

- The breather bag allows normal air vent operation in atmospheric storage tanks with full segregation between stored liquid product and atmospheric air.
- The breather bag maintains atmospheric qualification of storage tanks in mechanical design procedures.

BRIEF DESCRIPTION OF THE DRAWINGS

The schematic figures attached hereto make possible a better explanation about the objectives of the present invention. In the drawings:

FIGS. 5, 6, 7, 8, 9, and 10 are schematic drawings showing operating steps for the present invention breather bag installed in an atmospheric closed type storage tank;

FIGS. 11 and 12 are schematic drawings showing two other alternative forms for installing the present invention breather bag in an atmospheric closed type storage tank;

In the attached figures the same reference numbers identify similar elements.

DETAILED DESCRIPTION OF THE PRESENTLY PREFERRED EXEMPLARY EMBODIMENTS

Figure 1:
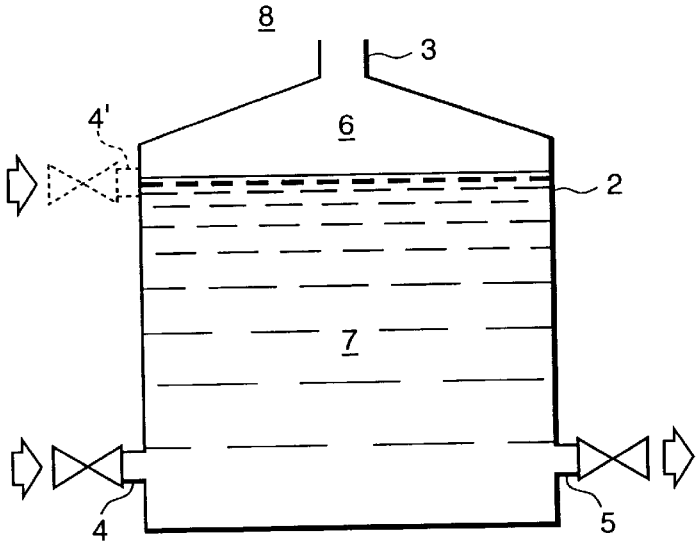
Fig. 1 (PRIOR ART)
FIG. 1 is a schematic drawing of a conventional atmospheric closed type storage tank.

In accordance with FIG. 1, a standard atmospheric closed type vertical storage tank 22 has the following parts: on the top, a neck containing an air vent or nozzle 3; liquid product inlet nozzle 4 or 4'; stored liquid product 7 and outlet nozzle 5. When the atmospheric storage tank is charged with stored liquid product 7, an upper portion inside the tank above product level includes a region called the vapor-space 6 that contains a mixture of atmospheric air+product vapors. The portion outside air vent nozzle 3 is the atmospheric air 8 of the environment.

Figure 2:
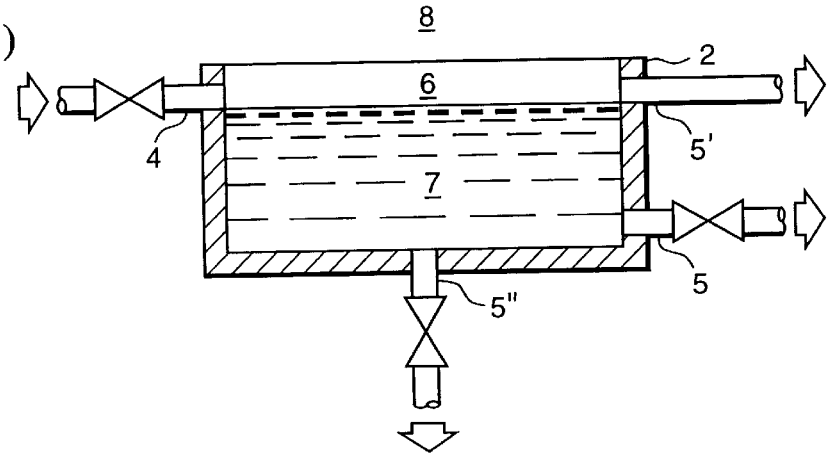
Fig. 2 (PRIOR ART)
FIG. 2 is a schematic drawing of a conventional atmospheric open type storage tank.

In accordance with FIG. 2, an atmospheric open type storage tank 2 includes the same parts as a standard atmospheric closed type vertical storage tank such as that shown in FIG. 1, but is neckless and has no air vent 3. It also includes two more outlet connection nozzles: to liquid product overflow 5' with a non-return check valve in the piping system and to liquid product drawing nozzle 5".

Either the inlet nozzle 4 or the outlet nozzle 5 may have an attached block valve for controlling liquid product flow in a piping system.

Figure 3:
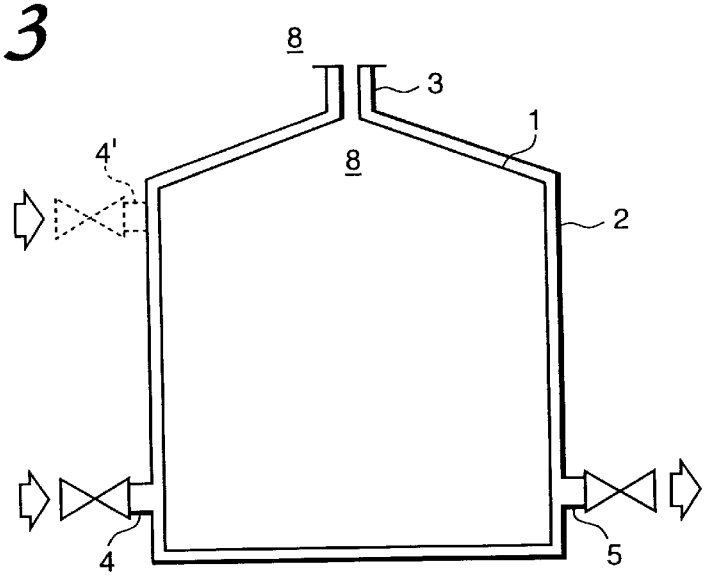
FIG. 3 is a schematic drawing of an atmospheric closed type storage tank having the present invention breather bag already installed.
Figure 4:
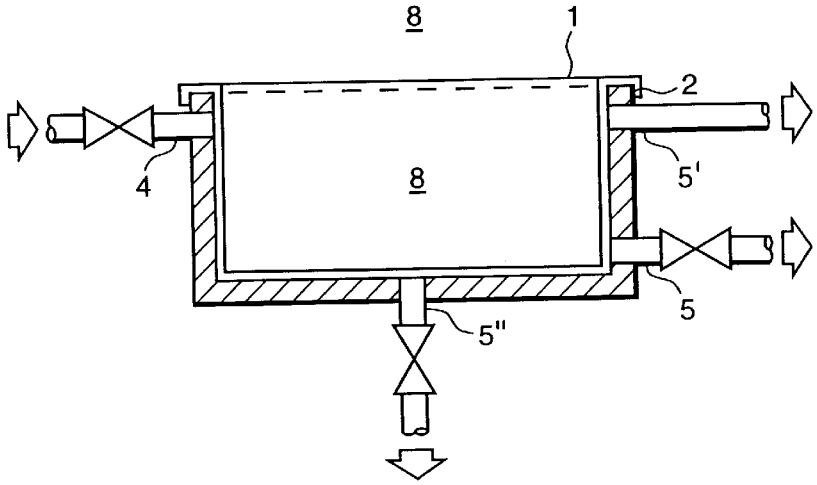
FIG. 4 is a schematic drawing of an atmospheric open type storage tank having the present invention breather bag already installed.

Otherwise, as shown in FIGS. 3 and 4, the present invention uses a breather bag 1 for the sealed vent of atmospheric storage tanks. Bag 1 is made with an impermeable and flexible membrane with shape and dimensions near to the form of the inner geometry of the atmospheric storage tank 2 with a thin wall thickness sufficient only to support a low magnitude positive pressure or vacuum and a minimum resistance to mechanical deformations, but with chemical corrosion resistance for operating stored liquid product 7. The upper open end of breather bag 1 is sealed to the upper opening of the tank in all embodiments.

Figure 5:
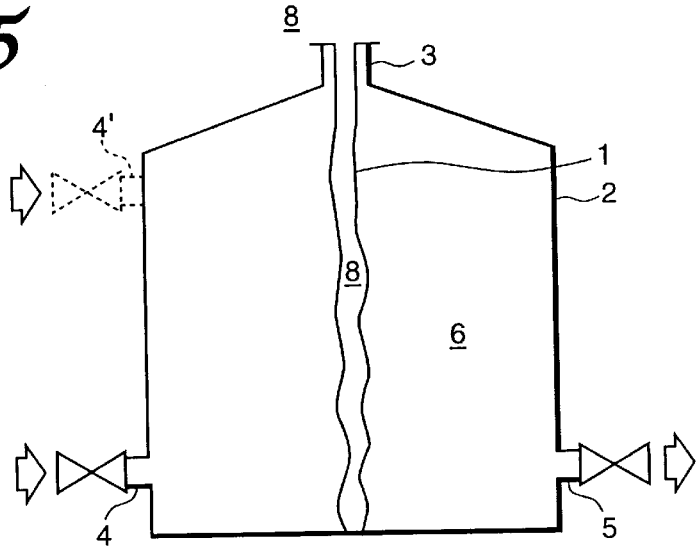
Figure 6:
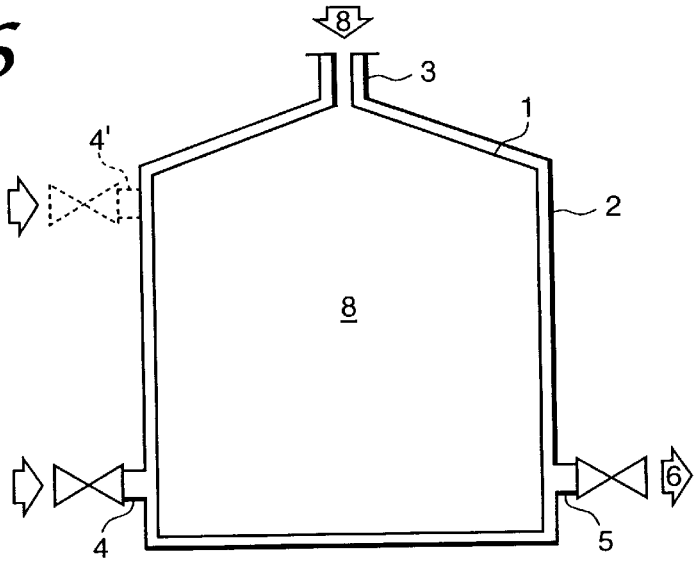

In an atmospheric closed type storage tank 2 totally empty of liquid product 7, as shown in FIG. 5, the breather bag is introduced into tank 2 and fastened to the conventional existing air vent nozzle 3. At the next step, atmospheric air 8 is blown into breather bag 1 while the internal air 6 of the tank is purged out. This operation may be performed with the block valve for inlet connection 4 in closed position and the block valve for outlet connection 5 in open position, so that atmospheric air 8 is blown into breather bag 1 through its open end as shown in FIG. 6.

In an atmospheric open type storage tank 2 breather bag 1 is installed flush to the tank's internal walls and fastened to the walls at their top side. See FIG. 4.

During a liquid product 7 filling operation into storage tank 2, atmospheric air 8 which was initially blown into breather bag 1 is now expelled, as shown in FIG. 7, to the environment excluding any stored product vapors. This process occurs because breather bag 1 is made with an impermeable membrane that becomes a physical barrier between stored liquid product 7 and the atmospheric air 8 in breather bag 1.

During withdrawal operation of stored liquid product 7 from a closed type storage tank 2, atmospheric air 8 enters into breather bag 1 through air vent nozzle 3 and it is kept segregated from stored liquid product 7.

FIGS. 5 to 10 show the sequence of operation steps of the breather bag 1 according to the present invention when it is installed in an atmospheric closed type storage tank 2.

BREATHER BAG INSTALLATION

FIG. 5 shows an empty breather bag 1 in a noncharged atmospheric closed type storage tank 2.

The breather bag 1, made with dimensions previously defined for each case, taking into account its geometrical particularities for each application, is introduced empty into non-charged atmospheric storage tank 2 through air vent nozzle 3.

The breather bag 1 must be fixed by a convenient way at air vent nozzle 3 so that this operation step will be responsible for an air-tight seal between the interior of atmospheric storage tank 2 and the environment.

ATMOSPHERIC AIR BLOWN INTO BREATHER BAG

FIG. 6 shows inflated breather bag 1 in the non-charged atmospheric closed type storage tank 2.

The empty breather bag 1 initially introduced into a non-charged atmospheric closed type storage tank 2 is then inflated with atmospheric air 8.

The steps for inflating empty breather bag 1 with atmospheric air 8 are as follows.

The block valve for inlet nozzle 4 is kept in a closed position.

The block valve for outlet nozzle 5 is kept in an open position to allow exhaust of air 6 initially contained inside the atmospheric closed type storage tank 2.

The atmospheric air 8 is blown into the empty breather bag 1 aided by an external atmospheric air 8 source or by air blower equipment.

The block valve for outlet nozzle 5 will be closed when breather bag 1 becomes fully inflated with atmospheric air 8, and the breather bag 1 will conform joined to an internal wall of the atmospheric closed type storage tank 2 as shown in FIG. 6.

ATMOSPHERIC CLOSED TYPE STORAGE TANK FILLING OPERATION

FIG. 7 shows the liquid product 7 filling operation in an atmospheric closed type storage tank 2.

The liquid product 7 is fed into an atmospheric closed type storage tank 2 through inlet nozzle 4 or 4' with its block valve in open position.

While liquid product 7 enters into the atmospheric closed type storage tank 2, atmospheric air 8 inside the breather bag 1 is expelled to the environment through vent nozzle 3. The exit of atmospheric air 8 from breather bag 1 does not permit atmospheric closed type storage tank 2 to become pressurized except due to the column height of storage liquid product 7.

In this operation step, it can be noted that stored liquid product 7 is segregated from atmospheric air 8 by breather bag 1. As the breather bag is in direct contact with the surface of the stored liquid product 7, evaporative change of liquid product 7 is avoided.

ATMOSPHERIC CLOSED TYPE STORAGE TANK HIGH LEVEL

FIG. 8 shows atmospheric closed type storage tank 2 fully charged with liquid product 7 up to a storage high level line.

When the storage tank high level line is reached by liquid product 7, feeding of the liquid product 7 through inlet nozzle 4 or 4' is stopped.

The breather bag 1 is empty, without atmospheric air 8 and it is drawn up in the tank vapor space to prevent being crushed in the liquid product 7. At this step it is observed that:

The stored liquid product 7 is segregated from atmospheric air 8.

Changes of the stored liquid product 7 due to evaporation are avoided.

Any volume variation of the stored liquid product 7 in the atmospheric closed type storage tank 2 due to changes in temperature either in the tank or in the environment is absorbed by breather bag 1.

Any extraneous objects that might be introduced through the air vent nozzle 3 normally into tank 2 will instead be kept inside the breather bag 1 physically segregated from the stored liquid product 7 by the breather bag.

ATMOSPHERIC CLOSED TYPE STORAGE TANK EMPTYING OPERATION

FIG. 9 shows the emptying operation of an atmospheric closed type storage tank 2 with withdrawal of stored liquid product 7 being through outlet nozzle 5.

The emptying operation of an atmospheric closed type storage tank 2 occurs by stored liquid product withdrawal through outlet nozzle 5 with the block valve for outlet nozzle 5 being kept in an open position.

The vacuum formed inside an atmospheric closed type storage tank 2 between breather bag 1 and tank 2 due to withdrawal of stored liquid product 7 is promptly counterbalanced by atmospheric air 8 being sucked into breather bag 1 due to vacuum pulling the bag downward. Thus, in an atmospheric closed type storage tank 2, failure can be avoided.

In this step, it is noted that the atmospheric air 8 introduced into tank 2 to counterbalance stored liquid product withdrawal is kept inside breather bag 1 and segregated from stored liquid product 7. This guarantees that stored liquid product 7 is free either of contamination or of changes in its quality that would occur due to the presence of atmospheric air 8 either containing water vapors or containing oxidizing compounds.

ATMOSPHERIC CLOSED TYPE STORAGE TANK LOW LEVEL

FIG. 10 shows stored liquid product 7 at the low level line of atmospheric closed type storage tank 2.

When storage tank 2 low level line is is reached by liquid product 7 the withdrawal operation is stopped. All atmospheric air 8 introduced to counterbalance the atmospheric closed type storage tank 2 emptying operation is kept inside the breather bag 1 and segregated from stored liquid product 7.

To remove breather bag 1 from atmospheric storage tank 2, atmospheric air 8 is introduced between breather bag 1 and inner side wall of atmospheric storage tank 2. The atmospheric air 8 exhaust operation in the breather bag 1 is done by introducing new air into the atmospheric storage tank 2 through inlet nozzle 4 or 4' while the block valve for outlet nozzle 5 is maintained in a closed position.

FIGS. 11 and 12 show two other alterative forms for installing the present invention breather bag 1 in an atmospheric closed type storage tank 2.

These figures present the following:

FIG. 11: Tank bottom attached breather bag 1;

FIG. 12: Multiplex breather bag 1.

BOTTOM ATTACHED BREATHER BAG

FIG. 11 shows breather bag 1 crushed into stored liquid product 7 with its lower part fixed at the bottom of atmospheric closed type storage tank 2.

During withdrawal of stored liquid product 7 from atmospheric storage tank 2, either the closed type or open type, the possibility may occur of the breather bag 1 clinging to the inner side wall of atmospheric storage tank 2. So, the lower part of breather bag 1 lower part may be fixed at the bottom of atmospheric storage tank 2 by adequate aids.

In this case, it is noted that during the filling operation of atmospheric storage tank 2 breather bag 1 will not float, but it will be crushed into stored liquid product 7 without disadvantage to the operation or to durability. Therefore, during a stored liquid product withdrawal operation, the possibility of breather bag 1 clinging at the inner side wall of storage tank 2 is avoided.

MULTIPLEX BREATHER BAG APPLICATION

More than one breather bag 1 may be used in an atmospheric storage tank 2, either a closed type or open type.

FIG. 12 shows application of multiple breather bags 1 in an atmospheric closed type storage tank 2.

Use of a multiplex breather bag 1 is recommended in the following cases:

The atmospheric storage tank 2 has dimensions too large for using a simple breather bag 1;

The atmospheric storage tank 2 has internal parts which may perturb the sound working of a single, simple breather bag.

FIGS. 13 to 16 show the present invention breather bag 1 operational steps when it is applied in an atmospheric open type storage tank 2.

Figure 13:
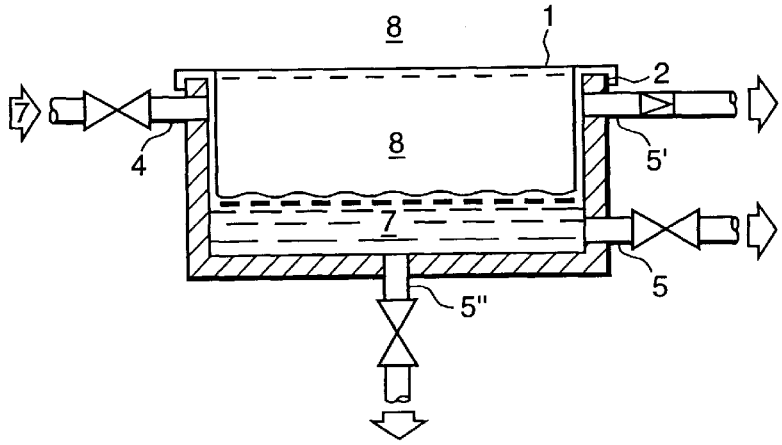
FIGS. 13, 14, 15 and 16 are schematic drawings showing operating steps for the present invention breather bag installed in an atmospheric open type storage tank.
Figure 14:
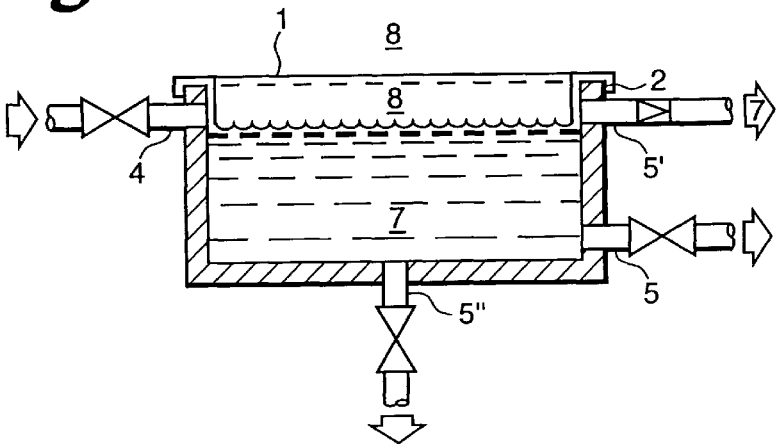
Figure 15:
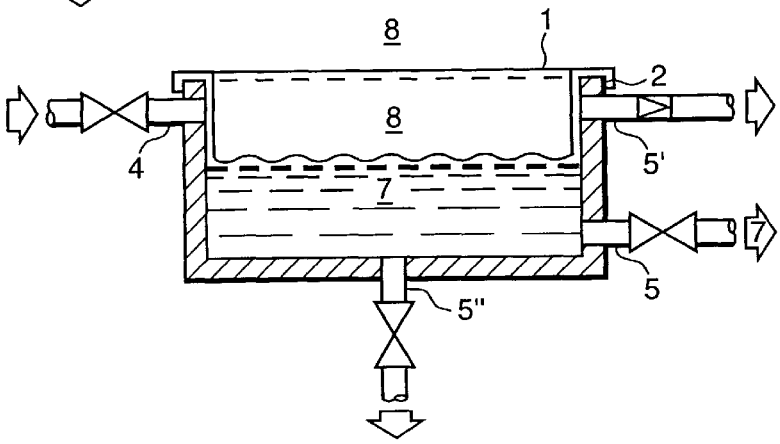
Figure 16:
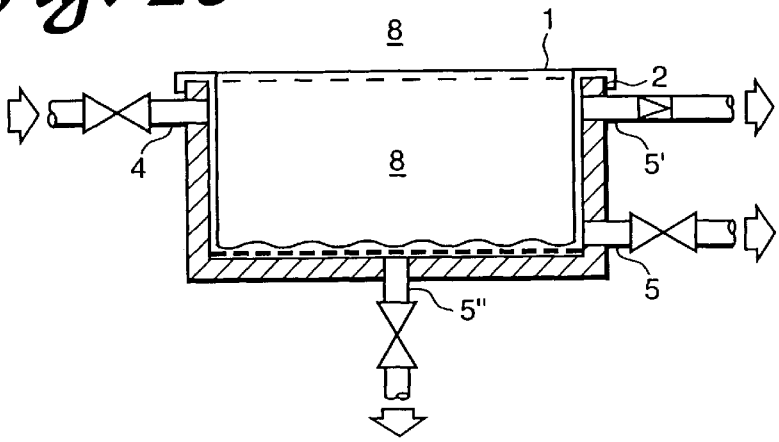

These figures show the following:

FIG. 13: Atmospheric open type storage tank filling operation;

FIG. 14: Atmospheric open type storage tank high level;

FIGS. 15: Atmospheric open type storage tank emptying operation;

FIG. 16: Atmospheric open type storage tank low level.

ATMOSPHERIC OPEN TYPE STORAGE TANK FILLING OPERATION

FIG. 13 shows the filling operation of an atmospheric open type storage tank 2 with inlet nozzle 4 feeding liquid product 7.

The liquid product 7 is fed into atmospheric open type storage tank 2 through inlet nozzle 4 with its block valve being kept in an open position.

As liquid product 7 enters into the atmospheric open type storage tank 2, the breather bag 1 is forced up and its space is occupied in tank 2 with liquid product 7.

In this operation step, it can be noted that stored liquid product 7 is segregated from atmospheric air 8. As the breather bag is in direct contact with the surface of the stored liquid product 7, evaporation of the liquid product 7 is avoided.

ATMOSPHERIC OPEN TYPE STORAGE TANK HIGH LEVEL

When the storing tank high level line is reached by liquid product 7, feed through inlet nozzle 4 is stopped.

FIG. 14 shows the atmospheric open type storage tank 2 fully charged with liquid product 7 up to a high level line.

The breather bag 1 will float and draw up over stored liquid product 7 surface or it will be crushed into stored liquid product 7.

At this step it is observed that:

The stored liquid product 7 is segregated from atmospheric air 8.

Evaporation of the stored liquid product 7 is avoided.

Any extraneous objects that would get into an atmospheric open type storage tank 2 will be retained by the breather bag 1.

ATMOSPHERIC OPEN TYPE STORAGE TANK EMPTYING OPERATION

FIG. 15 shows emptying an atmospheric open type storage tank 2 of stored liquid product 7 through outlet nozzle 5.

The atmospheric open type storage tank emptying operation by stored liquid product withdrawal is done through outlet nozzle 5 with its block valve in an open position.

During a stored liquid product withdrawal operation the breather bag 1 will adjust tightly to the inner wall of tank 2 and physical separation from stored liquid product 7 is maintained.

ATMOSPHERIC OPEN TYPE STORAGE TANK LOW LEVEL

FIG. 16 shows an atmospheric open type storage tank 2 with stored liquid product 7 at low level line.

When an atmospheric open type storage tank low level line is reached by liquid product 7, the withdrawal operation is stopped and the tank's liquid product stored portion will be segregated from atmospheric air 8 by breather bag 1.

Other embodiments and variations will be apparent to those of ordinary skill in the art, all such embodiments and variations, however, being encompassed by the scope of the following claims.

I claim:

1. A method for adding a liquid product to a tank including a breather bag disposed inside said tank and having normal dimensions corresponding to the inside dimensions of said tank and having an upper opening sealing an upper air vent of said tank, said method comprising the steps of:

inflating said bag through said upper opening by blowing external air into the interior of said bag before said tank contains any of said liquid product to conform the bag to said inside dimensions of said tank and, to purge the tank itself of any air, maintaining the interior of said bag in free communication with the environmental atmospheric air under atmospheric pressure via said upper opening in said bag, then adding said liquid product to said tank between the exterior of said bag and the interior of said tank, and simultaneously forcing said external air out of said bag via said upper opening into the atmosphere by the exertion of pressure on said bag by the liquid product as it is added to said tank, said liquid product being separated from said external air via said bag.

2. A method for adding a liquid product to a tank having an upper tank opening end, said method comprising the steps of:

inserting liquid product into said tank between said tank and a breather bag having normal dimensions corresponding to the inside dimensions of said tank and having an upper bag open end sealed to said tank opening and conforming to the interior wall of said tank by virtue of external air in said bag, forcing said external air out of said bag through said open end by the exertion of pressure on the bag by the liquid product as it is inserted into the tank inserting said breather bag into said tank via said upper tank opening, sealing said upper bag open end to said upper tank opening, and fixing a part of said bag to the bottom of said tank.

3. A method as claimed in claim 2, wherein said tank has a neck containing an air vent as said upper tank opening and to which said open end is sealed, and said method includes, prior to the step of inserting said liquid product, the step of filling said bag with external air via said open end to effect said external air in said bag to conform the bag to the internal wall of said tank.

4. A method as in claim 2 wherein said tank is neckless and wherein prior to the step of inserting said liquid product, atmospheric pressure causes said bag to be filled with said external air via said upper bag open end.

5. A method as in claim 2 including, prior to the step of inserting said liquid product, the steps of:

inserting said breather bag into said tank via said upper tank opening, and sealing said upper bag open end to said upper tank opening.

6. A method for adding a liquid product to a tank having an upper tank opening and disposed inside the tank a breather bag having normal dimensions corresponding to the inside dimensions of said tank and having an upper open end sealed to said tank opening, said method comprising the steps of:

opening an outlet valve of said tank to allow relief of pressure existing between said tank and breather bag, filling said bag via said upper opening with atmospheric air while said outlet valve is open and before said tank contains any of said liquid product to conform the bag to the interior wall of said tank and purge the tank itself of any air, closing said outlet valve, maintaining the interior of said bag in free communication with the environmental atmospheric air under atmospheric pressure via said upper open end of said bag, inserting liquid product into said tank between the exterior of said bag and the interior of said tank, and simultaneously forcing said atmospheric air out of said bag through said open end by the exertion of pressure on the bag by inserted liquid product.

7. A method as in claim 6, wherein said tank is of a closed type having a neck containing an air vent as said upper tank opening and to which said end is sealed, and the step of filling the bag with atmospheric air includes inflating the bag with atmospheric air.

8. A method as in claim 7, including removing inserted liquid from said tank via said outlet valve which tends to create between said bag and tank a vacuum which is counterbalanced by atmospheric air entering said bag via said open end.

9. A method as in claim 6, wherein said tank is of the neckless open type and the step of filling the bag with atmospheric air is accomplished by relieving pressure between the tank and bag when said outlet valve is opened to allow atmospheric pressure to fill said bag with atmospheric air.

* * * * *